US010182686B2

(12) United States Patent
Chen

(10) Patent No.: US 10,182,686 B2
(45) Date of Patent: Jan. 22, 2019

(54) SPRING-LOADED TOILET PAPER DISPENSER

(71) Applicant: Qing-Min Chen, Meridian, ID (US)

(72) Inventor: Qing-Min Chen, Meridian, ID (US)

( * ) Notice: Subject to any disclaimer, the term of this patent is extended or adjusted under 35 U.S.C. 154(b) by 0 days.

(21) Appl. No.: 15/887,036

(22) Filed: Feb. 2, 2018

(65) Prior Publication Data

US 2018/0220853 A1 Aug. 9, 2018

Related U.S. Application Data

(60) Provisional application No. 62/454,372, filed on Feb. 3, 2017.

(51) Int. Cl.

| | |
|---|---|
| ***A47K 10/32*** | (2006.01) |
| ***A47K 10/18*** | (2006.01) |
| ***A47K 10/22*** | (2006.01) |
| ***A47K 10/38*** | (2006.01) |

(52) U.S. Cl.

CPC ..... *A47K 10/32* (2013.01); *A47K 10/18* (2013.01); *A47K 10/22* (2013.01); *A47K 10/3836* (2013.01); *A47K 2010/3233* (2013.01); *A47K 2010/3253* (2013.01)

(58) Field of Classification Search

None

See application file for complete search history.

(56) References Cited

U.S. PATENT DOCUMENTS

| | | | | |
|---|---|---|---|---|
| 1,665,739 | A * | 4/1928 | Hoegger | A47K 10/40 101/216 |
| 4,732,255 | A * | 3/1988 | Bullard | G07F 11/045 194/233 |
| 5,191,995 | A * | 3/1993 | McDonald | A63B 47/002 221/227 |
| 5,887,818 | A | 3/1999 | Kelley | |
| 6,318,821 | B1 * | 11/2001 | Martin | A47K 10/38 221/226 |
| 6,422,503 | B1 | 7/2002 | Hoo Kong | |
| 6,769,566 | B1 * | 8/2004 | Rubin | A47F 1/06 221/56 |
| 6,843,369 | B2 | 1/2005 | Daniels | |
| 7,287,667 | B2 | 10/2007 | Brown | |
| 7,588,209 | B2 | 9/2009 | Demers | |
| 8,646,621 | B2 * | 2/2014 | Zacherle | A47F 1/126 206/526 |
| 8,998,033 | B2 | 4/2015 | Huard | |
| 2006/0273101 | A1 | 12/2006 | Lewis | |

* cited by examiner

*Primary Examiner* — Gene O Crawford
*Assistant Examiner* — Ayodeji T Ojofeitimi
(74) *Attorney, Agent, or Firm* — Neustel Law Offices

(57) ABSTRACT

A spring-loaded toilet paper dispenser for compact and aesthetic holding and dispensing of multiple rolls of toilet paper. The spring-loaded toilet paper dispenser generally includes an elongated housing to store rolls of toilet paper in a generally vertical stack until ready for use. The dispenser also includes a roller bar to hold an active roll of toilet paper, allowing for paper to be unrolled. When the active roll is empty, the roller bar slides into the topmost, next roll in the stack and then rotates to move the "on-deck" roll into the active position.

13 Claims, 11 Drawing Sheets

SPRING-LOADED TOILET PAPER DISPENSER

CROSS REFERENCE TO RELATED APPLICATIONS

I hereby claim benefit under Title 35, United States Code, Section 119(e) of U.S. provisional patent application Ser. No. 62/454,372 filed Feb. 3, 2017. The 62/454,372 application is currently pending. The 62/454,372 application is hereby incorporated by reference into this application.

STATEMENT REGARDING FEDERALLY SPONSORED RESEARCH OR DEVELOPMENT

Not applicable to this application.

BACKGROUND

Field

Example embodiments in general relate to a spring-loaded toilet paper dispenser for holding multiple rolls of toilet paper in storage and dispensing toilet paper from a roll in the top position of the dispenser.

Related Art

Any discussion of the related art throughout the specification should in no way be considered as an admission that such related art is widely known or forms part of common general knowledge in the field.

There are auto-feeding toilet paper dispensers on the market, but they are typically gravity-fed, hold just a few rolls at a time, and are not aesthetically pleasing. Such dispensers are typically designed and used for commercial environments, not for homes. Further, gravity-fed dispensers are limited in that they may not be free standing, and are typically mounted on vertical surfaces.

SUMMARY

An example embodiment is directed to a spring-loaded toilet paper dispenser. The spring-loaded toilet paper dispenser includes or may include a housing, which is generally vertical, in the form of a tower. The housing is capable of holding multiple rolls of toilet paper, also vertically, or substantially so. So configured, the roll on the bottom of the stack will be the last used, with the roll on the top of the stack being the "on deck" roll, to be used when the active roll is empty. The stack of rolls is supported at the bottom by a support platform, so that, as each on-deck roll is moved to the active position to be used, the entire stack is pushed up the distance of one roll, acted upon by the force of a spring, an elastic band, or other biasing member or device. A fixed or movable lid holds the top roll in place and may also serve as an anchor point for the spring or other biasing member.

The spring in the example embodiment can be a tension spring, secured near the top of the housing at one end, and to the support platform at the other end, thus exerting an upward force on the support platform. There may be two springs, one on each side of the vertical stack of toilet paper rolls.

The example embodiment also includes a roller device at or near the top of the stack. The roller device may include a roller bar that can slide back and forth in a rotation bracket, and the rotation bracket is also rotatable about an axis. When an active roll is used up, its empty tube can be easily removed from the roller bar, which supports each active roll. The roller bar can then be pushed into the center of the on-deck roll and then pivoted into position.

There has thus been outlined, rather broadly, some of the embodiments of the spring-loaded toilet paper dispenser in order that the detailed description thereof may be better understood, and in order that the present contribution to the art may be better appreciated. There are additional embodiments of the spring-loaded toilet paper dispenser that will be described hereinafter and that will form the subject matter of the claims appended hereto. In this respect, before explaining at least one embodiment of the spring-loaded toilet paper dispenser in detail, it is to be understood that the spring-loaded toilet paper dispenser is not limited in its application to the details of construction or to the arrangements of the components set forth in the following description or illustrated in the drawings. The spring-loaded toilet paper dispenser is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Figure 1:
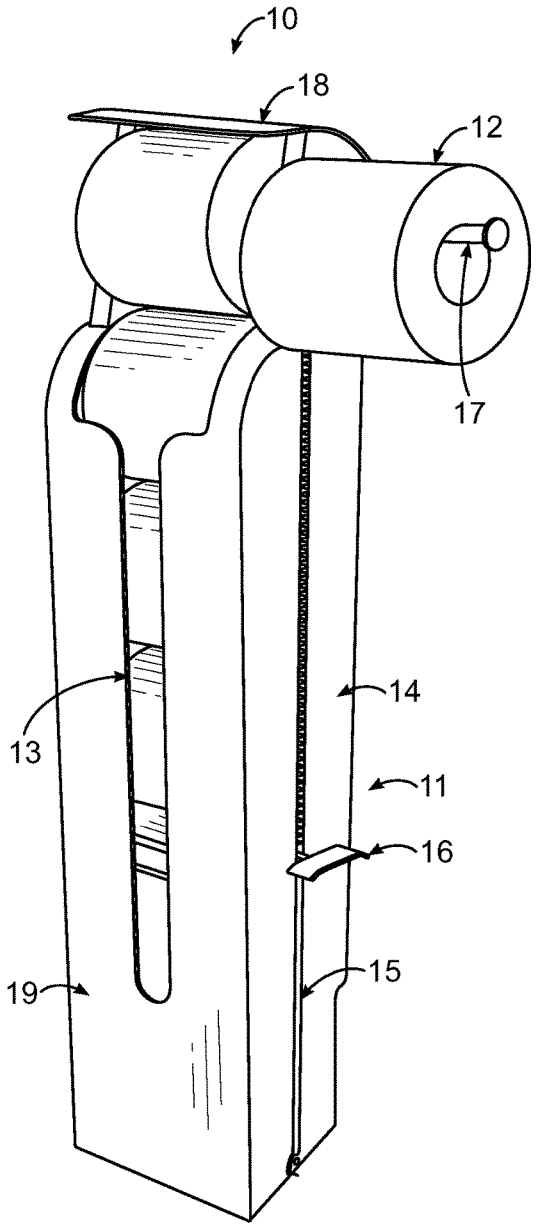
FIG. 1 is a perspective view of a spring-loaded toilet paper dispenser in accordance with an example embodiment.

A. Overview.

An example spring-loaded toilet paper dispenser generally comprises a vertical housing 11 suitable for holding a vertical stack of toilet paper rolls. The stack of toilet paper rolls is supported by a support platform or member 20 which is biased by one or more springs 21 or other biasing members to urge the rolls upward as they are used. The housing also may include a lid 18 or a top section, which holds the uppermost toilet paper roll in place until it is ready for use. Accordingly, the roll on the bottom of the stack will be the last one used, with the roll on the top of the stack being the on-deck roll, to be used when the active roll is empty.

The example embodiment also includes a roller device at or near the top of the stack. The roller device may include a roller bar 17 that can slide back and forth in a rotation bracket 34, and the rotation bracket 34 is also rotatable about an axis. When an active roll is used up, its empty tube can be easily removed from the roller bar 17, which supports each active roll. The roller bar 17 can then be pushed into the center of the on-deck roll and then pivoted into position to allow the active roll to be used.

B. Housing.

An example spring-loaded toilet paper dispenser generally comprises a vertical housing suitable for holding a vertical stack of toilet paper rolls. The stack of toilet paper rolls is supported by a platform or support member which is biased by one or more springs or other biasing members to urge the rolls upward as they are used. The housing also may include a lid or a top section, which holds the uppermost toilet paper roll in place until it is ready for use. Accordingly, the roll on the bottom of the stack will be the last one used, with the roll on the top of the stack being the on-deck roll, to be used when the active roll is empty.

Figure 2:
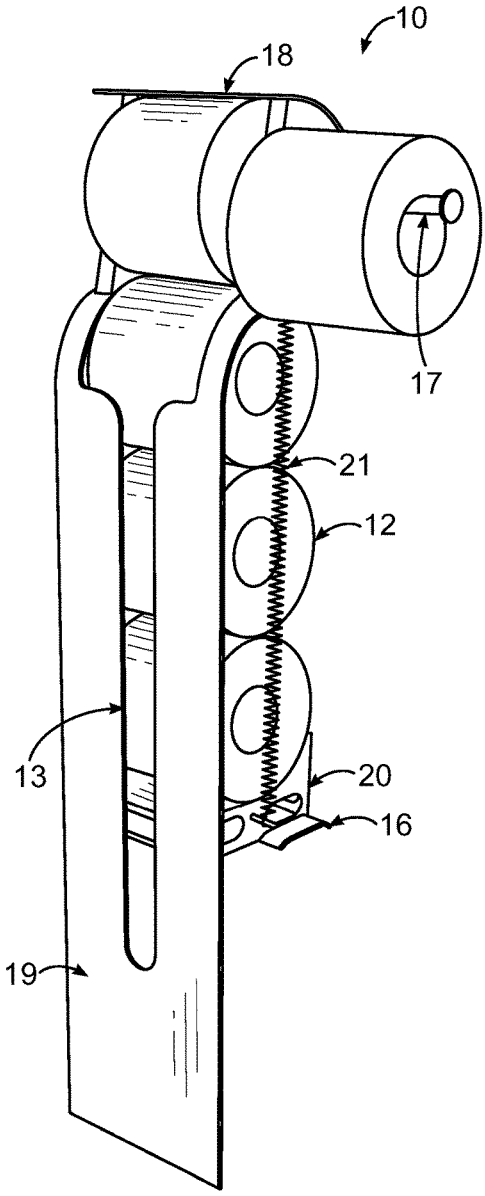
FIG. 2 is another perspective view of a spring-loaded toilet paper dispenser in accordance with an example embodiment, with part of the housing not shown.

As best shown in FIGS. 1 and 2, an example embodiment of a dispenser 10 may include a housing 11, which is generally vertical. The housing, as well as other components of the dispenser, may be made of virtually any suitable material, such as metal, wood, or plastic. The housing, or parts of it, can even be fabricated using 3D printing techniques. The housing 11 is generally sized to hold a number of toilet paper rolls 12 in a stack.

Figure 3:
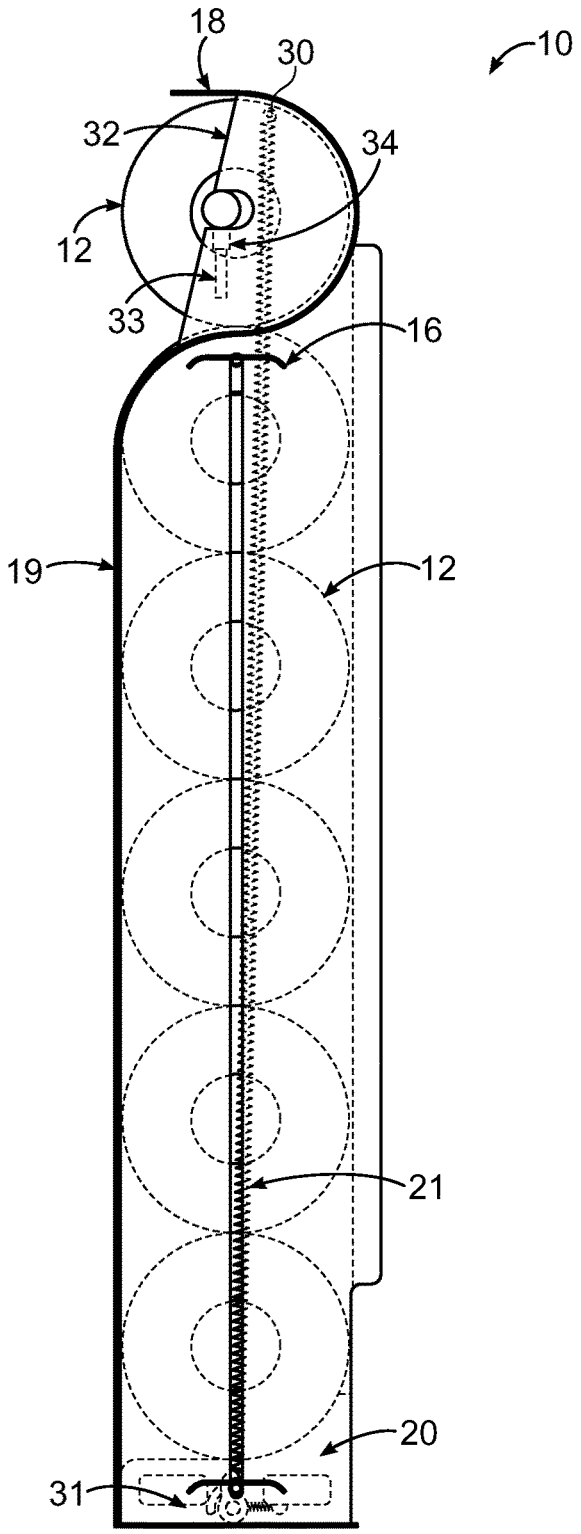
FIG. 3 is a side view of a spring-loaded toilet paper dispenser in accordance with an example embodiment.

As shown in FIG. 1, the housing 11 may include sides 14 with slots or cutouts 15, which allow handles 16 to extend through the housing 11 from a support member or platform (not shown) that supports the bottom roll. The housing 11 also includes a face 19. As best shown in FIG. 3, face 19 can be made from a single piece of metal (or other material) and bent or formed as shown to create a rounded top portion with an opening (see FIG. 1) and a lid 18.

Figure 6:
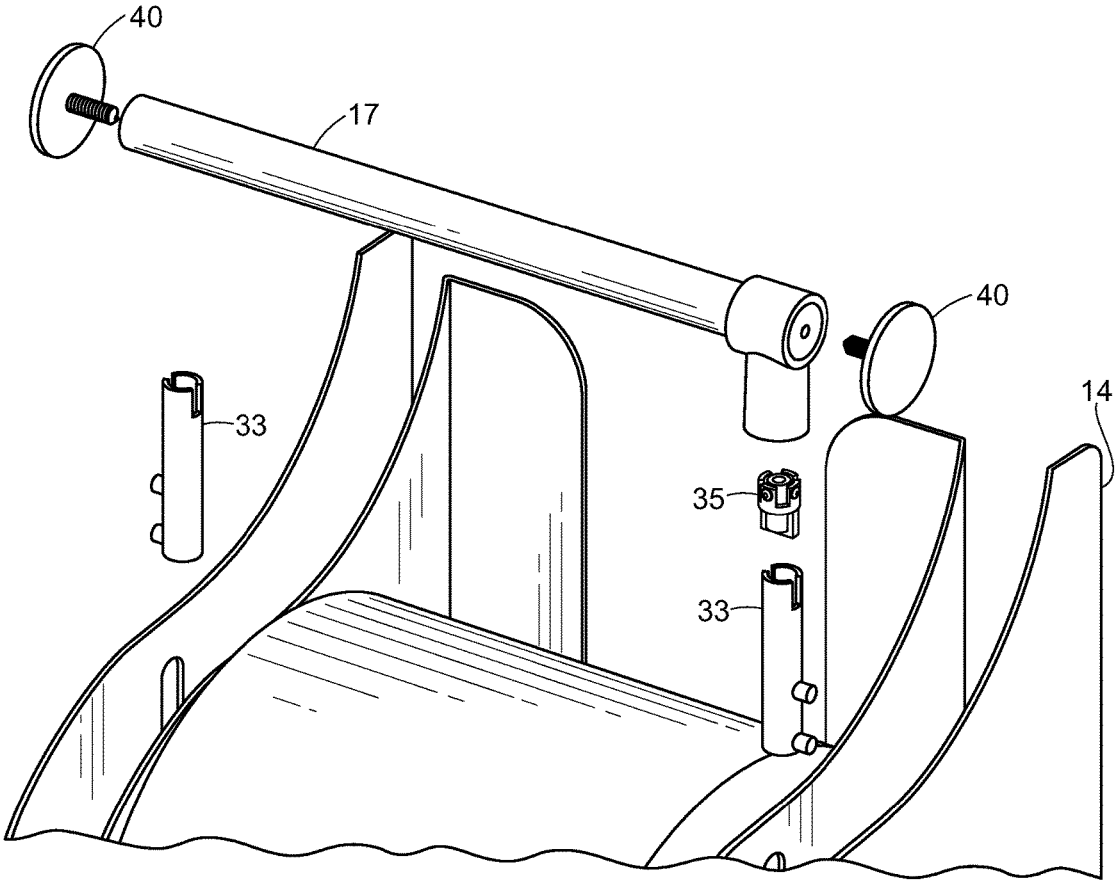
FIG. 6 is an exploded view of a roller bar assembly of a dispenser in accordance with an example embodiment.

The face 19 may be welded or attached to sides 14 to form the housing 11, which may or may not also include a back (not shown). The sides 14 of the housing may, as also shown in FIGS. 1 and 2, contain or conceal some of the mechanisms of the dispenser 10. This may be done, for example, by forming the sides 14 of two walls of metal, as shown in FIG. 6. As thus shown, the sides 14 have an inner chamber that contains a spring 21, as discussed further below. With the spring 21 thus within sides 14, the face 19 and sides 14 of the housing 11 form a relatively smooth inner chamber, generally rectangular as viewed from the top, that contains the stack of toilet paper rolls 12.

Figure 14:
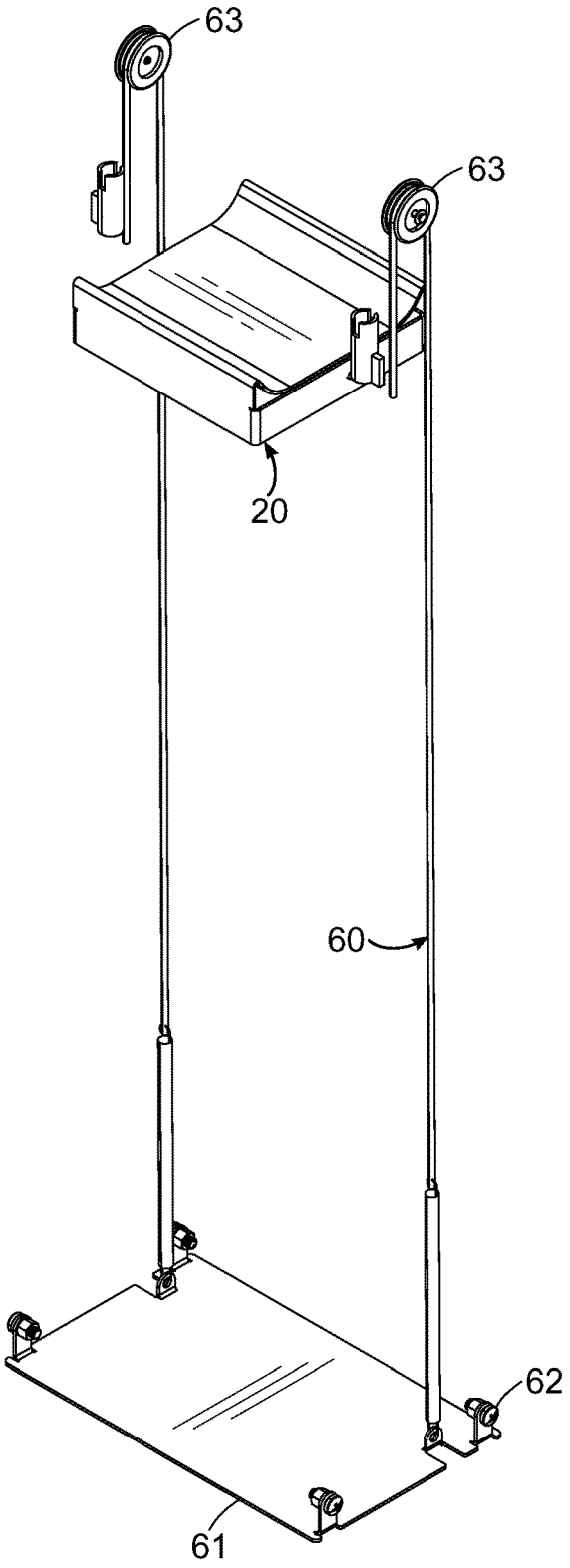
FIG. 14 is a detailed perspective view illustrating an alternative elastic biasing mechanism in accordance with an example embodiment of the dispenser.

At the bottom, the housing 11 can also include a base 61, as shown in FIG. 14. The base 61 adds stability to the housing, forms the bottom of the housing 11, and can also be used to secure rubber bands 60 as described below in an alternative embodiment of the dispenser 10. As shown in FIGS. 1-3, the housing also includes a lid 18, which may be formed as an integral part of face 19, or separately formed. The lid 18 holds the uppermost or "on-deck" roll 12 in place until it is ready for use. Lid 18 may be movable or fixed, depending on the individual design or for aesthetic purposes.

As shown FIG. 1, the housing 11 is sized to hold six rolls in a stack, plus one roll in the active position—that is, for ready use. Of course, the dispenser may be of different sizes and configurations, and accordingly may hold more or fewer rolls, depending on the design. As also shown in FIG. 1, the housing may include a front cutout 13 for viewing how many rolls of toilet paper remain in the dispenser. The front cutout 13 can also be used to manually adjust or access the rolls if needed. Further, as best shown in FIG. 4, the face 19 of housing 11 can include a wider opening at the top so that the rolls 12 may be pushed into position toward lid 18.

C. Support Platform and Spring Mechanism.

As shown in FIGS. 1 and 2, the dispenser 10 includes a support member or platform 20 that fits within the inner chamber of housing 11. The platform is sized and shaped to allow for it to smoothly move up and down within the housing. The support platform 20 is under tension applied by springs 21 so that it is urged upward, pushing the stack of toilet paper rolls upward for dispensing and use, as will be described below. As shown in FIG. 2, the support platform 20 may be shaped with a partially round part to engage the bottom roll of toilet paper. The support platform 20 may also include handles 16 to which springs 21 are attached, although the springs 21 may be attached differently. In the example embodiment, handles 16 extend through the slots 15 in the sides of housing 11.

Figure 4:
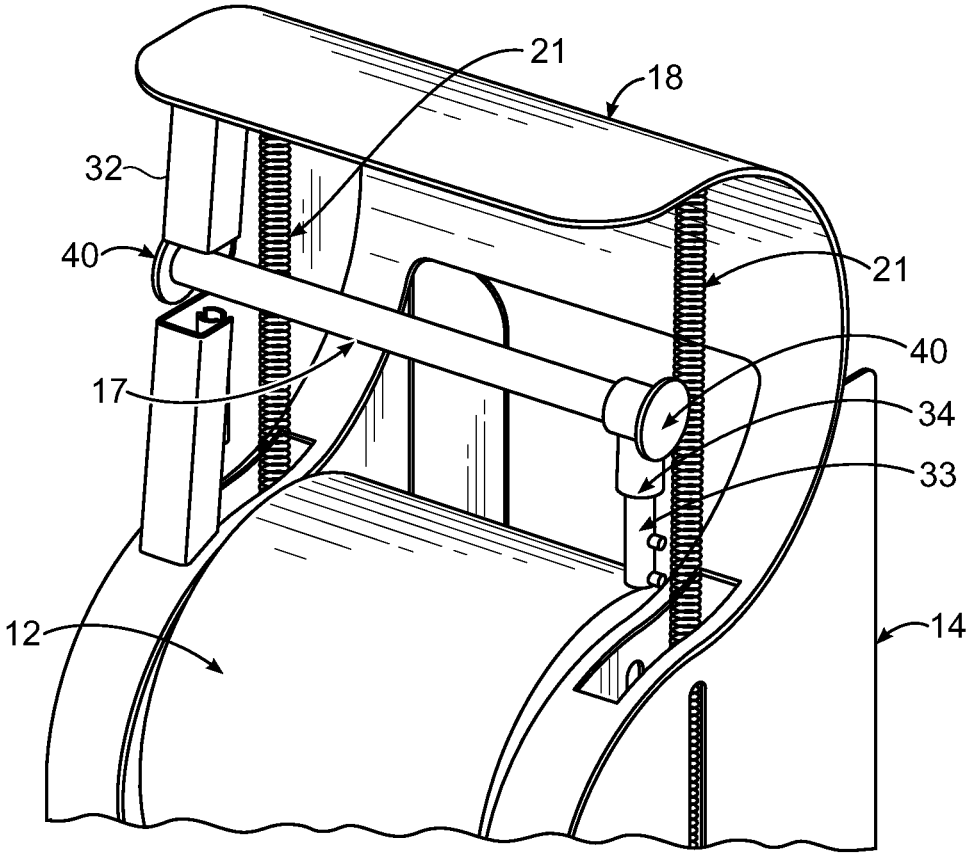
FIG. 4 is a detailed perspective view of the top portion of a dispenser in accordance with an example embodiment.

Springs 21 in the example embodiment extend through slots formed on both sides of face 19, as shown in FIG. 4. The tops of the springs 21 are anchored to the inside of lid 18.

FIG. 14 illustrates an alternate embodiment of the biasing mechanism, which in this case is a rubber band 60 or elastic. The basic operation of the dispenser 10 is the same for both the spring version and the rubber band version. As shown, this embodiment includes two rubber bands 60 attached to a base 61, which is attached to the bottom of sides 14 with screws 62, or by other fasteners or methods. As shown, the rubber bands 60 are then passed around discs 63 that are attached near the top of the dispenser 10, and then attached to the support platform 20. As with the spring embodiment, the support platform 20 is thus urged upward to dispense the rolls 12. The discs 63 can be attached to the sides 14 or the end pieces 32, although other attachment methods are possible.

D. Dispensing Mechanism.

As best seen in FIGS. 4 and 6, the dispenser includes near the top a dispensing mechanism generally comprising a roller bar 17, a rotation bracket 34, and a mounting rod 33. The mounting rod 33 is typically mounted to end piece 32, although the right end piece 32 is not shown in FIG. 4 so that the rest of the mechanism can be more clearly seen. The roller bar 17 has an end cap 40 affixed to each end. The roller bar 17 is held in various operating positions by a rotation bracket 34. Roller bar 17 can slide back and forth within rotation bracket 34, but is held in place by end caps 40, which prevent the roller bar 17 from being pushed all the way through rotation bracket 34. Note that the rotation bracket 34 can be mounted on either side of the dispenser 10, so that a toilet paper roll in the active position can either be on the left side or the right side of the dispenser 10.

Any user can move the rotation bracket 34 to either side of the dispenser by simply pulling the rotation bracket 34 off of the mounting rod 33 on one side and pushing it onto the mounting rod 33 on the other side of the dispenser 10. A rotation button 35 holds the rotation bracket 34 on the mounting rod 33 and also has a detent mechanism so that when the roller bar 17 is swung from one position to another, it clicks into position.

Figure 5:
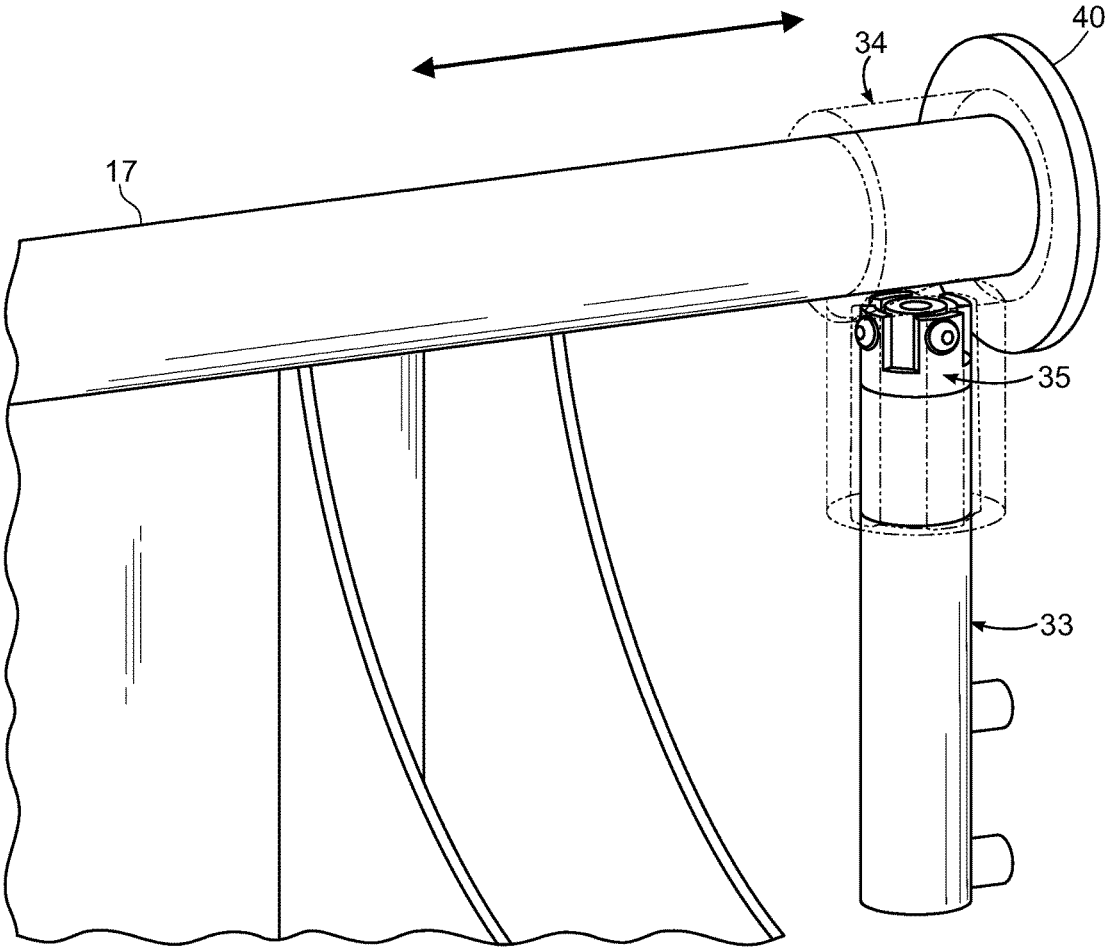
FIG. 5 is a detailed perspective view of a roller bar assembly of a dispenser in accordance with an example embodiment.
Figure 7:
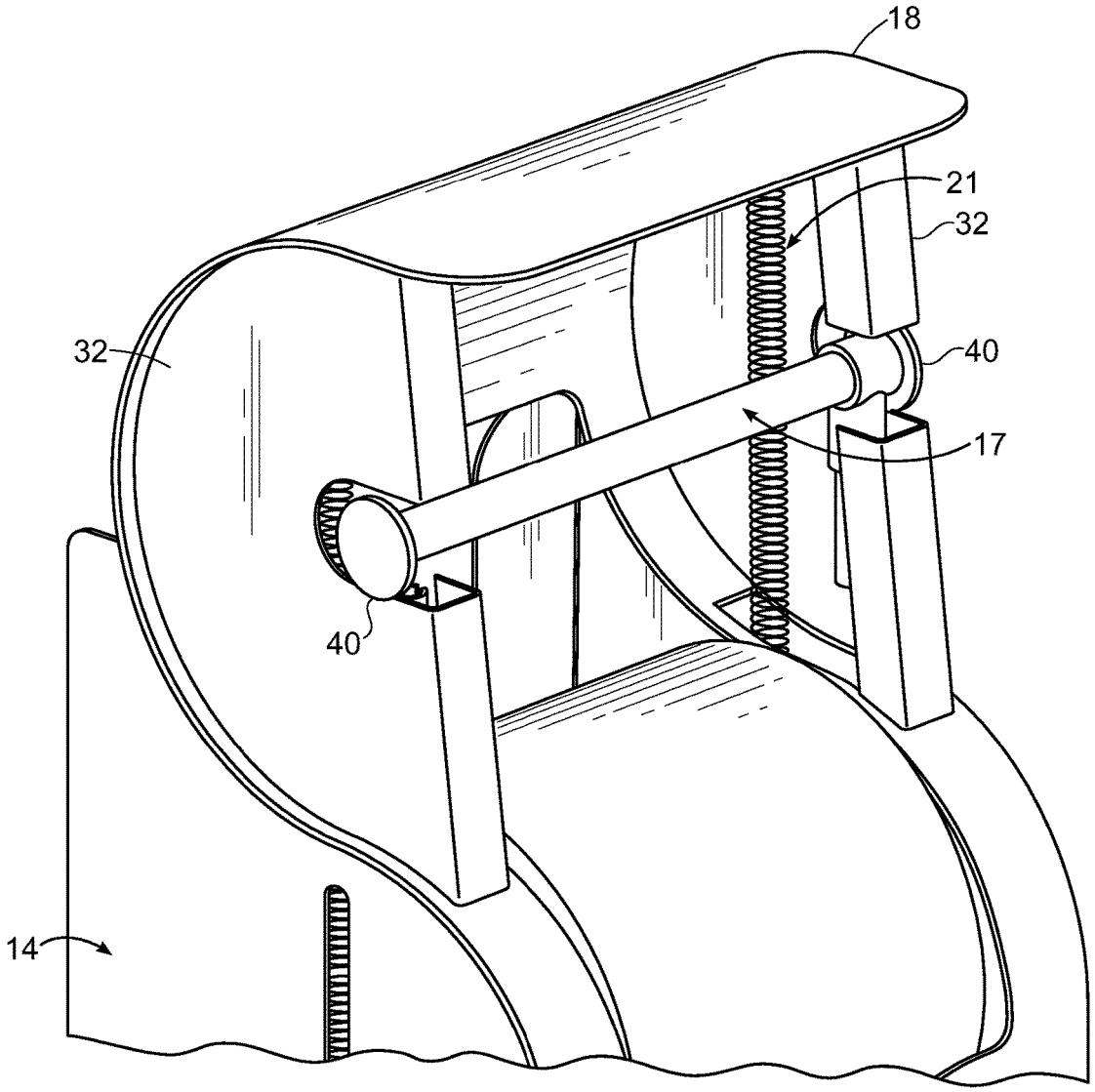
FIG. 7 is a detailed perspective view of the top portion of a dispenser in accordance with an example embodiment.

FIGS. 5, 6, and 7 show some of these components in greater detail. Rotation button 35 acts as a coupler between rotation bracket 34 and mounting rod 33. Protrusions on rotation button 35 that fit into channels in rotation bracket 34, allowing the bracket to rotate but gently click into position. Roller bar 17 can slide back and forth within the upper bore of rotation bracket 34 in the direction of the arrow. In addition to sliding back and forth, roller bar 17 also rotates, in order to move toilet paper rolls from the on-deck position to the active position. Viewed from the top of FIG. 6, roller bar 17 would rotate counter-clockwise to move a roll from the on-deck position into the active position. FIG. 7 shows rotation brackets 34 attached to end pieces 32, which have cutouts to allow for the rotation described above.

E. Locking Mechanism.

Figure 12:
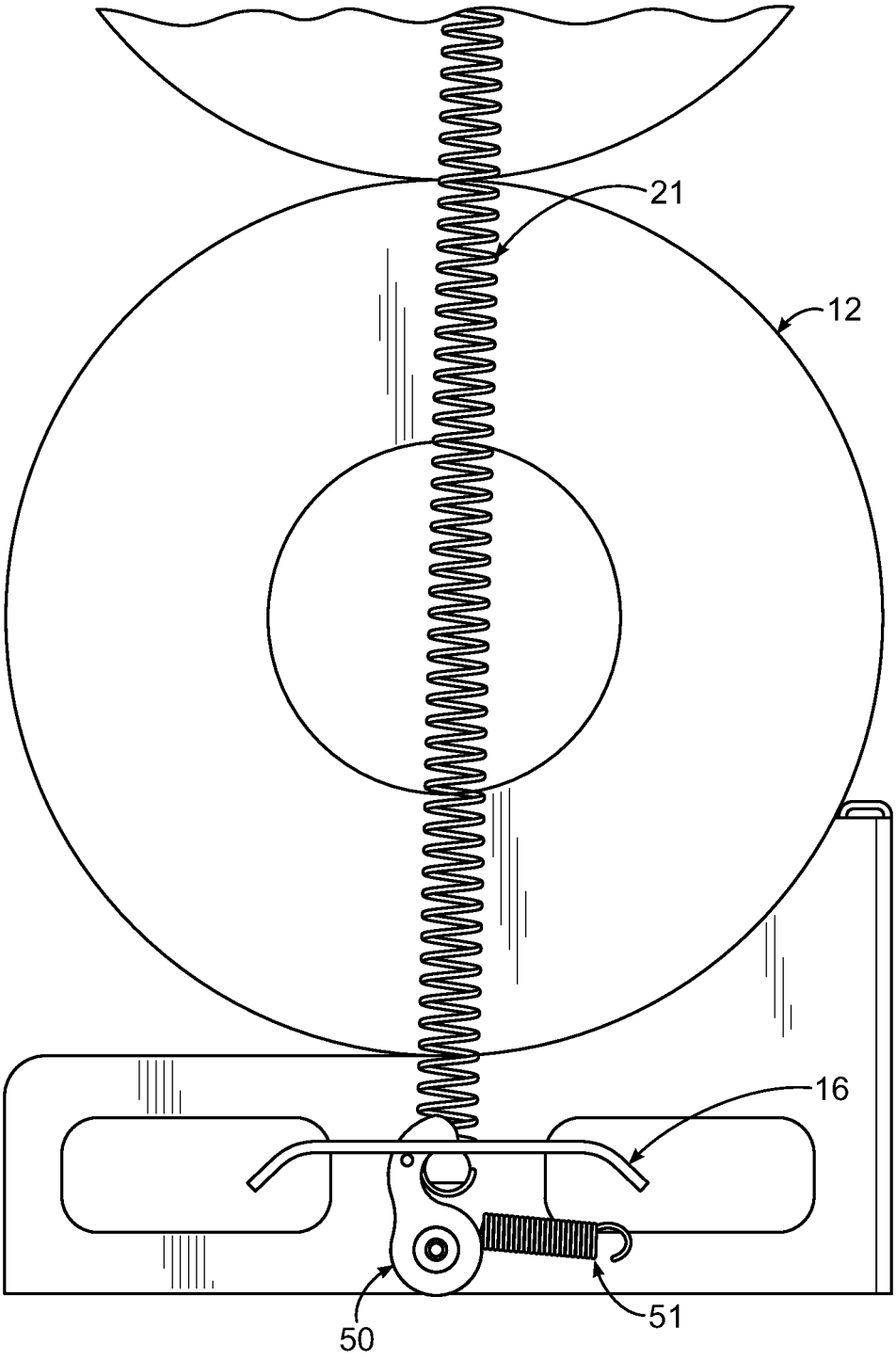
FIG. 12 is a side view further illustrating a locking mechanism in accordance with an example embodiment, showing the locked position.
Figure 13:
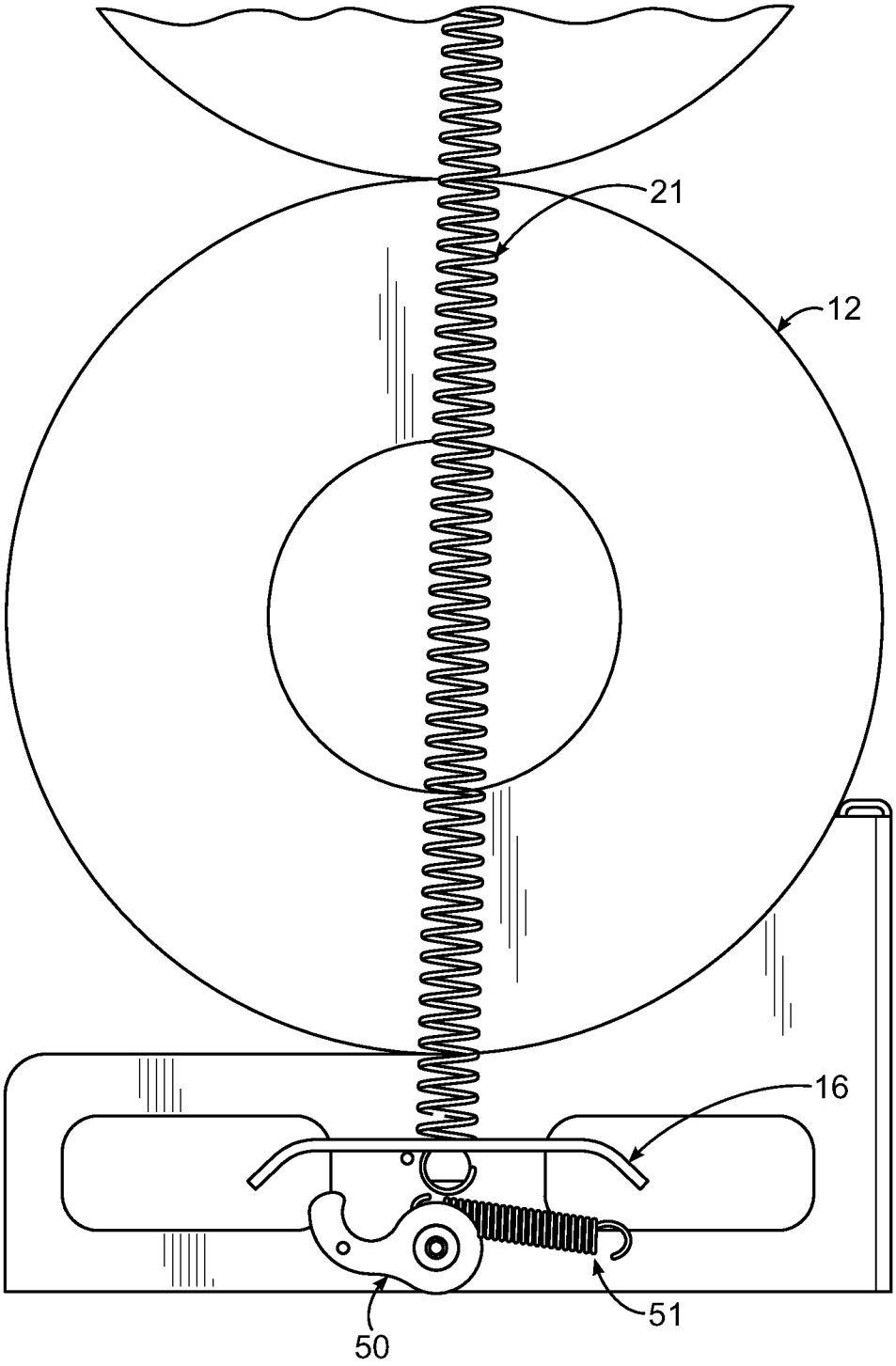
FIG. 13 is a side view further illustrating a locking mechanism in accordance with an example embodiment, showing the unlocked position.

FIGS. 9-13 illustrate the locking mechanism 31 in detail. The mechanism comprises a locking gear 50 that engages with the portion of handle 16 (not shown) that extends through slot 15 when the support platform 20 is at the bottom of the dispenser 10. Locking spring 51 pulls the locking gear 50 toward the locked position, so that the support platform 20 is engaged automatically when a user pushes the handles down. This facilitates loading of the dispenser 10 with toilet paper rolls 12, by allowing users to use both hands to load the dispenser 10. The locking mechanism 31 is released by pulling a locking release 52 back. The locking mechanism 31 is held in place on housing 11 with a screw 53 and a lock washer 54. FIG. 12 shows the dispenser 10 with the support platform locked in place, and FIG. 13 shows it with the locking mechanism 31 in the released position.

F. Operation of Preferred Embodiment.

Figure 8:
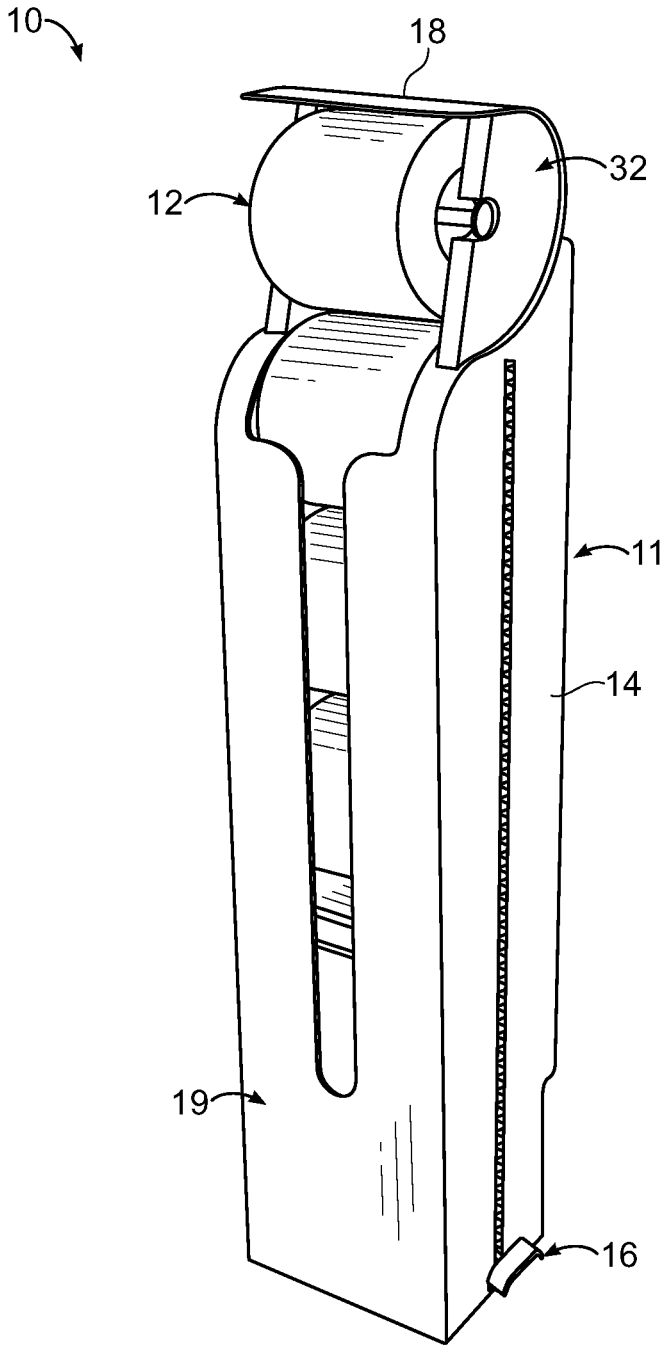
FIG. 8 is another perspective view of a spring-loaded toilet paper dispenser in accordance with an example embodiment.
Figure 9:
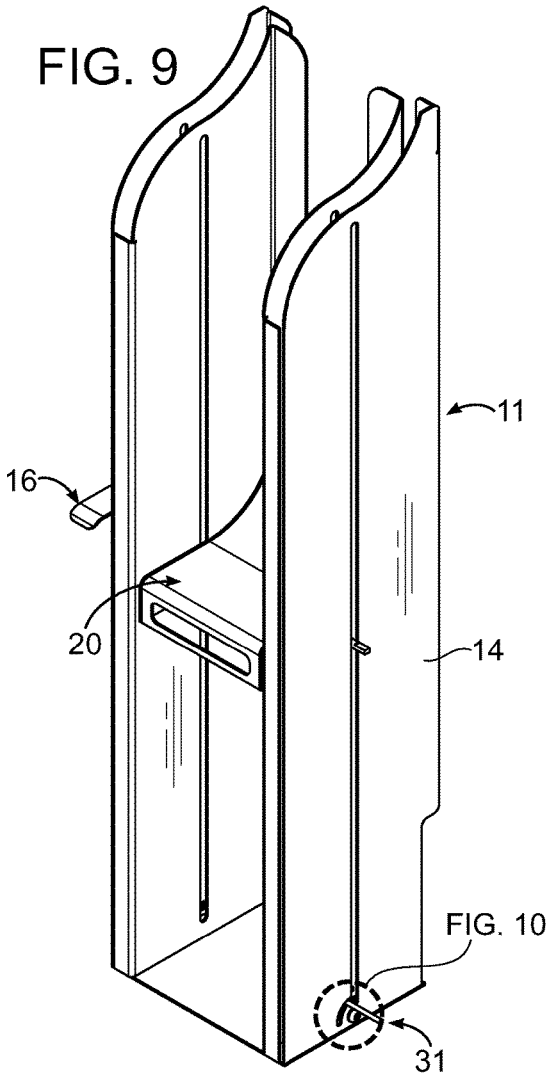
FIG. 9 is a perspective view of a spring-loaded toilet paper dispenser in accordance with an example embodiment that shows additional internal details and the location of a locking mechanism.
Figure 10:
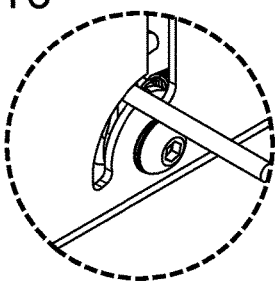
FIG. 10 is a perspective view further illustrating a locking mechanism in accordance with an example embodiment.
Figure 11:
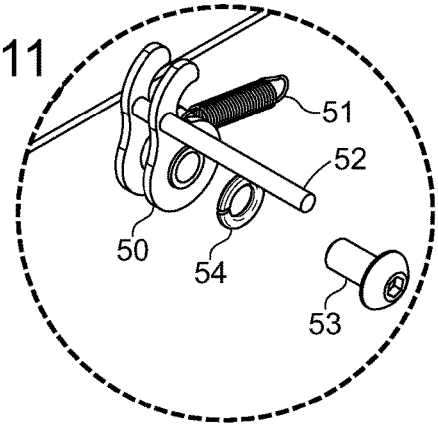
FIG. 11 is an exploded view further illustrating a locking mechanism in accordance with an example embodiment.

In use, the dispenser 10 is first loaded with rolls of toilet paper 12. Referring to FIG. 1, to load the dispenser, a user pulls the handles 16 down until the support platform 20 locks in place, and then adds toilet paper rolls 12 in a vertical stack as shown. FIG. 8 shows the dispenser 10 in fully loaded condition, but without a roll 12 in the active position. This is the condition the dispenser 10 would be in just after a user loads it. Next, the user pushes the roller bar 17 to the left (with reference to FIG. 6), onto the top roll 12, the on-deck roll.

Once the roller bar is within the tube of top roll 12, the roller bar 17 is pivoted counter-clockwise so that the roll 12 is moved to the active position to the right of the dispenser 10. This condition is shown in FIG. 1, with an active roll 12 in position to be used, supported by roller bar 17. When the on-deck roll is thus pivoted into the active position, the next roll in the stack will move into the on-deck position, raised by springs 21 or rubber bands 60. When the active roll is used up, a user simply lifts it off the roller bar 17 and pushes roller bar 17 to the left into the tube of the on-deck roll, and then pivots the roller bar back to the active position. The process of moving rolls from the on-deck position to the active position is repeated as needed, and the dispenser 10 can be reloaded with rolls at any time, whether the dispenser is empty or not.

As discussed above, the dispenser may be used with the active roll in either the right or left position with respect to the housing 11. Referring again to FIG. 1, when the active roll is empty, the user simply removes it from roller bar 17 and pushes roller bar 17 into the on-deck roll and pivots the on-deck roll into the active position, repeating the process as needed until all the rolls are used. Obviously, it is also possible to reload the dispenser at any time, rather than waiting until the last available roll is used up.

Unless otherwise defined, all technical and scientific terms used herein have the same meaning as commonly understood by one of ordinary skill in the art to which this invention belongs. Although methods and materials similar to or equivalent to those described herein can be used in the practice or testing of the spring-loaded toilet paper dispenser, suitable methods and materials are described above. All publications, patent applications, patents, and other references mentioned herein are incorporated by reference in their entirety to the extent allowed by applicable law and regulations. The spring-loaded toilet paper dispenser may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A toilet paper dispenser, comprising:

a generally elongated housing having an upper end, a lower end, a lid, and an opening, the lid and the opening proximate to the upper end, wherein the housing is configured to receive a plurality of rolls of toilet paper arranged in a stack, and to dispense the rolls from the upper end;

a support member movably positioned within the housing and configured to support one or more of the plurality of rolls of toilet paper;

a biasing member connected between the housing and the support member, wherein the biasing member urges the support member toward the upper end of the housing, and wherein the plurality of rolls of toilet paper are held between the support member and the lid for dispensing from the opening;

a roller bar pivotally attached to the dispenser, wherein the roller bar is adapted for holding toilet paper rolls; and a rotation bracket, wherein the rotation bracket is adapted to allow the roller bar to pivot and to slide linearly within the rotation bracket, wherein the rotation bracket is removably attached to the dispenser and is adapted to be movable to either a first side or a second side of the housing.

2. The toilet paper dispenser of claim 1, further comprising at least one releasable lock adapted to hold the support member at the lower end of the housing.

3. The toilet paper dispenser of claim 1, further comprising at least one handle attached to the support member.

4. The toilet paper dispenser of claim 3, wherein the at least one handle extends to the outside of the housing.

5. The toilet paper dispenser of claim 1, further comprising at least one handle attached to the support member, wherein the at least one handle extends to the outside of the housing.

6. The toilet paper dispenser of claim 5, wherein the biasing member comprises at least one spring having a first spring end and a second spring end, wherein the at least one spring is attached to the lid at the first spring end and is attached to the support member at the second spring end.

7. The toilet paper dispenser of claim 5, wherein the biasing member comprises at least one elastic band having a first end and a second end, wherein the first end is attached proximate the lower end of the housing and the second end is attached to the support member, and wherein the at least one elastic band passes over at least one pulley attached to the dispenser proximate the upper end of the housing.

8. The toilet paper dispenser of claim 5, wherein the biasing member comprises at least one spring having a first spring end and a second spring end, wherein the at least one spring is attached to the lid at the first spring end and is attached to the support member at the second spring end, further comprising:

at least one releasable lock adapted to hold the support member at the lower end of the housing.

9. The toilet paper dispenser of claim 5, wherein the biasing member comprises at least one elastic band having a first end and a second end, wherein the first end is attached proximate the lower end of the housing and the second end is attached to the support member, and wherein the at least one elastic band passes over at least one pulley attached to the dispenser proximate the upper end of the housing, further comprising:

at least one releasable lock adapted to hold the support member at the lower end of the housing.

10. The toilet paper dispenser of claim 1, wherein the biasing member comprises at least one spring having a first spring end and a second spring end, wherein the at least one spring is attached to the lid at the first spring end and is attached to the support member at the second spring end.

11. The toilet paper dispenser of claim 10, further comprising at least one releasable lock adapted to hold the support member at the lower end of the housing.

12. The toilet paper dispenser of claim 1, wherein the biasing member comprises at least one elastic band having a first end and a second end, wherein the first end is attached proximate the lower end of the housing and the second end is attached to the support member, and wherein the at least one elastic band passes over at least one pulley attached to the dispenser proximate the upper end of the housing.

13. The toilet paper dispenser of claim 12, further comprising at least one releasable lock adapted to hold the support member at the lower end of the housing.

* * * * *